US010039429B2

(12) United States Patent
Alton

(10) Patent No.: US 10,039,429 B2
(45) Date of Patent: Aug. 7, 2018

(54) AIR CUSHION VACUUM CLEANER

(71) Applicant: James R. Alton, Bellingham, WA (US)

(72) Inventor: James R. Alton, Bellingham, WA (US)

( * ) Notice: Subject to any disclaimer, the term of this patent is extended or adjusted under 35 U.S.C. 154(b) by 256 days.

(21) Appl. No.: 14/999,022

(22) Filed: Mar. 18, 2016

(65) Prior Publication Data

US 2016/0278590 A1 Sep. 29, 2016

Related U.S. Application Data

(60) Provisional application No. 62/177,646, filed on Mar. 20, 2015.

(51) Int. Cl.

| | |
|---|---|
| ***A47L 7/06*** | (2006.01) |
| ***A47L 5/36*** | (2006.01) |
| ***A47L 9/14*** | (2006.01) |

(52) U.S. Cl.

CPC ..... *A47L 7/06* (2013.01); *A47L 5/362* (2013.01); *A47L 9/14* (2013.01)

(58) Field of Classification Search

CPC ..... A47L 7/06; A47L 5/362; A47L 9/14
USPC ..... 15/327.3
See application file for complete search history.

(56) References Cited

U.S. PATENT DOCUMENTS

| | | | | |
|---|---|---|---|---|
| 978,916 | A | 12/1910 | Matchette | |
| 1,083,408 | A | 1/1914 | Matchette | |
| 1,247,654 | A | 11/1917 | Farnsworth | |
| 2,037,557 | A | 4/1936 | Ahnstrom | |
| 2,287,474 | A | 6/1942 | Hansson | |
| 2,332,208 | A | 11/1943 | Dow | |
| 2,439,182 | A | 4/1948 | Nuffer et al. | |
| 2,652,902 | A | 9/1953 | Sheahan | |
| 2,719,600 | A | 10/1955 | Brace | |
| 2,743,787 | A | 5/1956 | Seck | |
| 2,780,826 | A | 2/1957 | Coons et al. | |
| 4,527,302 | A * | 7/1985 | Maurer | A47L 5/362 15/325 |
| 5,210,996 | A * | 5/1993 | Fassauer | A01D 34/695 15/327.3 |
| 5,553,347 | A * | 9/1996 | Inoue | A47L 5/28 15/327.3 |
| 5,799,363 | A * | 9/1998 | Inoue | A47L 5/30 15/327.3 |
| 6,209,167 | B1 | 4/2001 | Rooney et al. | |

(Continued)

FOREIGN PATENT DOCUMENTS

| | | |
|---|---|---|
| CA | 2665962 | 11/2010 |
| DE | 1152507 | 8/1963 |

(Continued)

*Primary Examiner* — Weilun Lo
(74) *Attorney, Agent, or Firm* — Todd N. Hathaway

(57) ABSTRACT

A vacuum cleaner canister assembly supported on a cushion of air. A generally concentric series of ridges and channels surround a domed pocket in the base of the canister assembly. Air discharged into the pocket escapes under the ridges and flows into the channels so as to be distributed about the base of the assembly. The pocket is located generally beneath the center of mass and on the centerline of the assembly. A collection chamber also accumulates collected particulate so as to be located generally proximate the center of mass. An inlet tube at the front of the assembly is angled downwardly towards the floor to reduce the load on the canister assembly from the weight of the hose.

14 Claims, 26 Drawing Sheets

(56) References Cited

U.S. PATENT DOCUMENTS

| | | | |
|---|---|---|---|
| 8,015,658 | B2 | 9/2011 | Tan |
| D665,546 | S | 8/2012 | Van Den Heuvel |
| 2010/0218337 | A1 | 9/2010 | Tan |
| 2013/0014342 | A1 | 1/2013 | Greer |

FOREIGN PATENT DOCUMENTS

| | | |
|---|---|---|
| JP | 06133900 | 5/1994 |
| WO | WO2010130052 | 11/2010 |
| WO | WO2011072388 | 6/2011 |

* cited by examiner

AIR CUSHION VACUUM CLEANER

RELATED CASES

This application claims the benefit of U.S. Provisional Patent Application Ser. No. 62/177,646, filed Mar. 20, 2015.

BACKGROUND a. Field of the Invention

The present invention relates to household and commercial vacuum cleaners for removing dirt from flooring and other surfaces, and, more particularly, to a canister-type vacuum cleaner in which the body of the vacuum cleaner is supported above the floor's surface on a cushion of air exhausted from a vacuum motor that also provides vacuum airflow for the assembly.

b. Related Art

Canister-type vacuum cleaners in which the main body of the vacuum cleaner is supported on a cushion of exhaust air have existed within the art, but with varying degrees of success. Perhaps the most famous is the Hoover™ Constellation™ which in its original form was introduced in the mid-1950s and produced into the 1970s, and which was re-released more recently in modified form. Another example is the more recent Airider™ floating vacuum. These and other examples of "floating" air cushion vacuum cleaners that have been proposed or manufactured are shown in the following U.S. and foreign patents:

U.S. Pat. No. 6,209,167 (Rooney et al.)
U.S. Pat. No. 8,015,658 (Tan)
U.S. Pat. No. D665,546 (Van Den Heuvel)
US 2013/0014342 (Greer)
WO2011072388A (Greer)
CA2665962A1 (Greer)

Air cushion vacuum cleaners, also referred to from time-to-time herein as floating vacuum cleaners or hovering vacuum cleaners, offer many potential advantages over their conventional counterparts in which the canister is supported on wheels or casters. For example, a canister floating on a cushion of air is free to move in any direction without the resistance caused by wheels or casters having to pivot or being constrained to turning through an arc; in effect, the air cushion enables the canister to pivot and turn freely in either direction with essentially no resistance from the standpoint of the operator. The air cushion also enables the canister to glide over the floor surface with no rolling resistance or friction as compared with wheels or casters, and without being impeded by or becoming "bogged down" in the pile of carpeted floors. The absence of wheels supporting the weight of the canister also reduces the potential for marring or otherwise marking hardwood flooring or similar surfaces.

In practice, however, the advantages described above have only been partially achieved owing to limitations and drawbacks of prior air cushion vacuum cleaners. A common drawback has been the lack of stability and inability to maintain a level orientation during use, due in significant part to the lack of compensation for variances in the canister's center of gravity caused by both external loads as well as by shifting internal loads as dirt/dust accumulates inside the canister.

For example, only the canister assembly of the vacuum cleaner, which serves to house the motor and the bag or other dust/dirt collector, is ordinarily supported on the cushion of air, with suction being supplied from the canister through a hose to a nozzle that the user moves over the floor surface, furniture, drapes, and so on in order to remove dirt and dust.

In newer and more effective machines, such nozzles frequently include motors and brushes of their own, commonly referred to as "power nozzles." Power nozzles require a relatively heavy, electrified "power hose" which adds significant weight to the front of floating canisters, more so than the lighter, non-electric hoses commonly used with non-powered nozzles and attachments. The weight of the hose combined with the pulling action in various directions as the operator moves the nozzle assembly about the floor and other surfaces tends to upset the orientation of the canister and cause the air to escape more on one side or the other, or more at the front or rear or vice versa, with the result that the canister may tilt to the point of contacting or "digging into" the carpet or other surface, and thereby compromise its ability to turn and move without resistance. Additionally, the heavy power hose may be exchanged from time-to-time for a lighter non-electric hose for use with non-powered accessories, for example, thus changing the load on the front of the canister and impacting its ability to maintain a horizontal orientation. Furthermore, while prior floating canisters may be able to glide more-or-less freely over uniform surfaces, they frequently encounter difficulties at transitions, such as between hard and carpeted floor surfaces or over thresholds, where the flow of air creating the cushion under the canister may be disrupted or otherwise compromised in one area or another and the resulting uneven lift tends to cause the canister to dive or tilt in an undesirable manner.

Other difficulties in prior designs have included inefficient creation of the air cushion and related problems, along with power requirements and added weight. While sophisticated by standards of the day, the inherent weightiness and limited shapes available in the stamped metal construction used in the classic Hoover™ Constellation™ vacuum combined to require a powerful motor in order to generate the necessary lift (the size of the motor in itself adding to the weight), resulting in a noisy and heavy machine that is difficult to lift and carry up stairs or otherwise move about manually. Modern plastic construction has allowed more recent designs to enjoy somewhat reduced weights, as well as more sophisticated airflow contours and paths. Yet problems such as "fluttering" (where an excessive weight-load at the canister's rear causes an escape of the air cushion frontward in rapid bursts) or "nose diving" (where an excessive weight-load at the canister's front causes an escape of the air cushion rearward) remain, due in large part to a failure to compensate for the shifting center of gravity caused by weight-load variations, as well as inefficient development and distribution of the air cushion on the canister's underside.

Accordingly, there exists a need for an air cushion-supported canister for vacuum cleaners that creates, distributes and maintains the air cushion in an efficient manner, so as to both improve performance and reduce the amount of power that is required to support the canister. Furthermore, there exists a need for such an air cushion-supported canister assembly having a reduced weight so that the canister is both more easily supported by the air cushion, and is light enough to be carried by the user upstairs and to various locations around the home or office. Still further, there exists a need for such an air cushion-supported canister assembly having improved stability and floating performance when maneuvering in conjunction with a vacuum hose cleaning nozzle. Still further, there exists a need for such an air cushion-supported canister assembly having improved stability and floating performance while experiencing variances in the canister's weight load, such as when a bag or dirt compartment fills during use, or when the front of the canister is lightly weighted with a non-electrified hose compared to being more heavily weighted with an electrified power hose. Still further, there exists a need for such a canister assembly that is able to move smoothly over transitions and changes in height of floor surfaces, such as between carpeted and hard floor surfaces and over irregular thresholds, for example.

SUMMARY OF THE INVENTION

The present invention addresses the problems cited above, and provides a vacuum cleaner canister assembly supported by a stable and efficiently generated cushion of air.

In a first aspect, the canister assembly comprises a base assembly that generates an air cushion to support the canister assembly, the base assembly comprising: (a) an exhaust port through which a flow of air exhausted from a motor of the canister assembly is discharged below the base assembly; (b) an upwardly domed pocket having the exhaust port located therein so that the flow of air exiting the exhaust port is received and constrained within the domed pocket; (c) a first depending ridge circumscribing the domed pocket, under which air escapes from the pocket so as to generate lift against a floor surface underlying the base assembly; (d) an upwardly recessed first channel circumscribing the first ridge into which the air escaping under the first ridge flows so as to be distributed about the domed pocket; (e) a second depending ridge circumscribing the first channel under which said flow of air escapes from said first channel so as to generate lift against the underlying floor surface; (f) a second upwardly recessed channel circumscribing the second ridge that receives and distributes the flow of air about the second ridge; and (g) a third depending ridge circumscribing the second channel under which the flow of air escapes from the second channel so as to generate additional lift against the underlying floor surface.

The dependent ridges and the upwardly recessed channels may be arranged concentrically about the domed pocket that receives the flow of air from the exhaust port. The domed pocket may be located generally beneath a center of mass of the canister assembly. The pocket and channel may cooperate to form forward and rearward regions of the lift aligned generally along a longitudinal axis of the canister assembly. The forward region may span a relatively broader width under the canister assembly and the rearward region may span a relatively narrower width. The forward and rearward regions of lift may be located generally forwardly and rearwardly of a center of gravity of the canister assembly.

The canister assembly may further comprise an upper housing assembly, comprising: (a) a filter chamber; and (b) a blower motor that draws the flow of air through the filter chamber and expels the flow of air through the exhaust port into the domed pocket on the bottom of the base assembly. The filter chamber may be located towards a first end of the canister assembly and the blower motor may be located towards a second end of the canister assembly. The center of gravity of the canister assembly may be located generally intermediate the filter chamber and the blower motor of the canister assembly.

The upper housing assembly may further comprise an intake tube in fluid communication with a vacuum hose, the inlet tube having a discharge end that is angled to direct the flow of air towards a rearward side of the filter chamber that is located towards the center of mass of the canister assembly, so that heavy particulate carried by the flow of air accumulates adjacent the rearward wall of the filter chamber so as to be proximate the center of mass of the canister assembly. A filter bag may be placed in the filter chamber to collect the particulate that is carried by the flow of air.

The inlet tube may further comprise an inlet end that is mounted to the vacuum hose in generally axial relationship thereto. The inlet end may be forwardly and downwardly angled so that the vacuum hose extends forwardly and outwardly towards the floor surface underlying the canister assembly so as to reduce loading on the canister assembly due to weight of the vacuum hose.

These and other features and advantages of the present invention will be more fully appreciated from a reading of the following detailed description with reference to the accompanying drawings.

DETAILED DESCRIPTION

Figure 1:
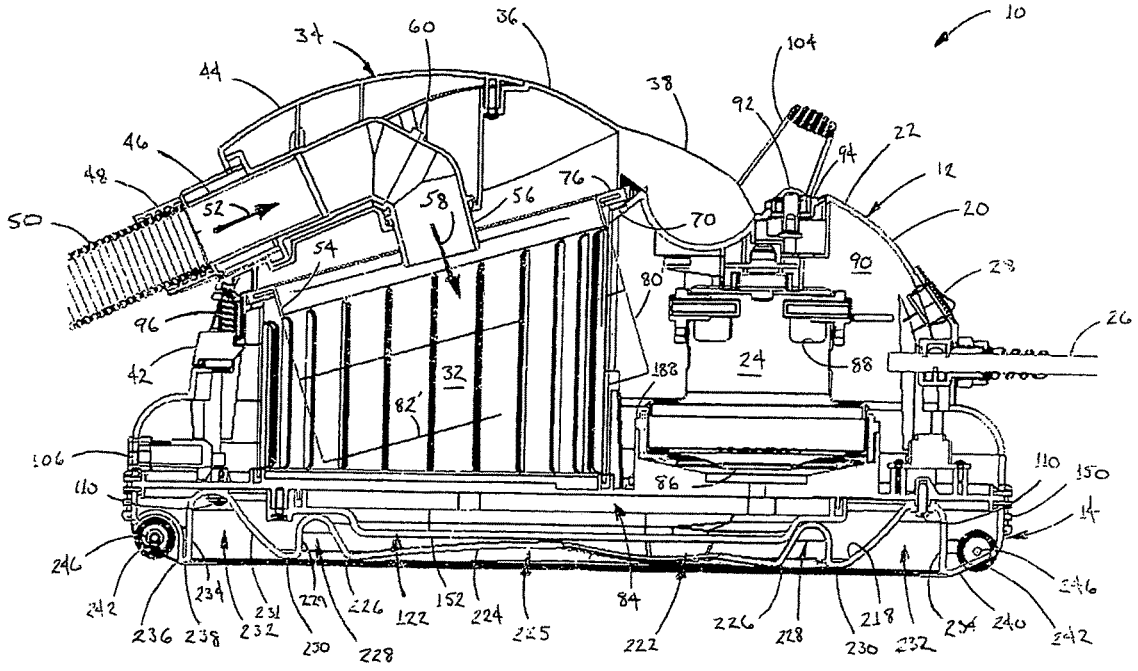
FIG. 1 is a longitudinal cross-sectional view of an air cushion-supported vacuum cleaner canister assembly in accordance with an embodiment of the present invention.
Figure 2:
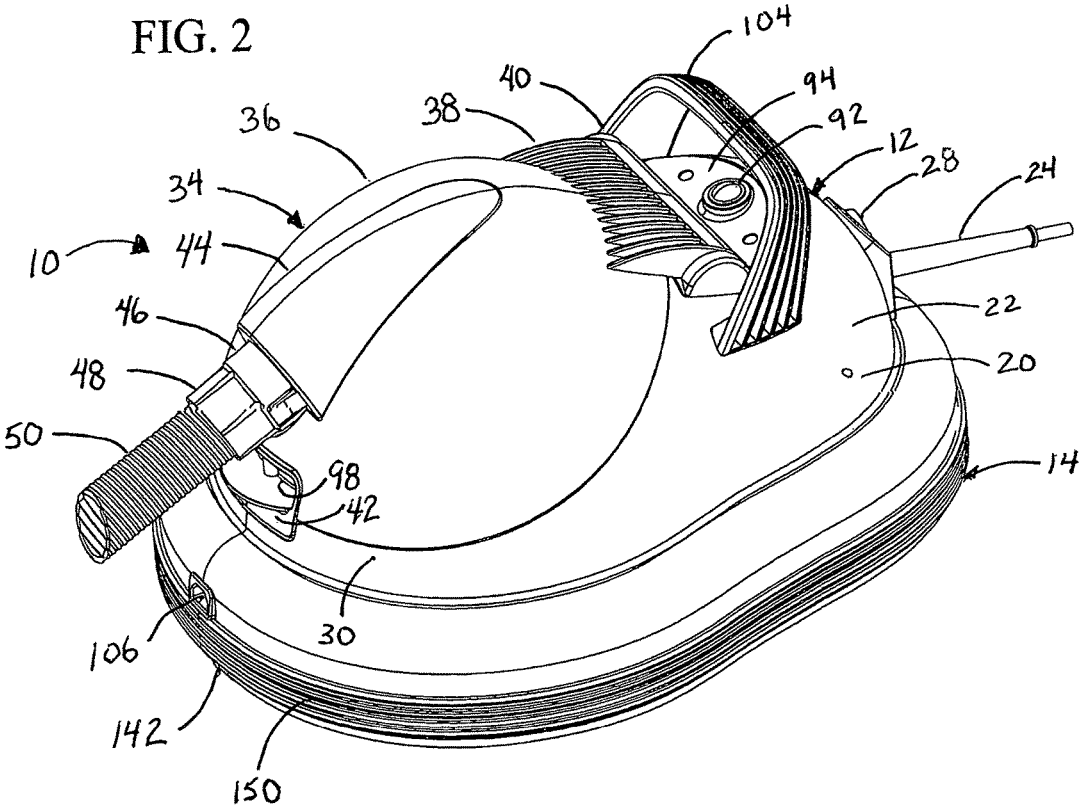
FIG. 2 is an upper front perspective view of the air cushion-supported vacuum cleaner canister assembly of FIG. 1, showing the external features thereof in greater detail.
Figure 3:
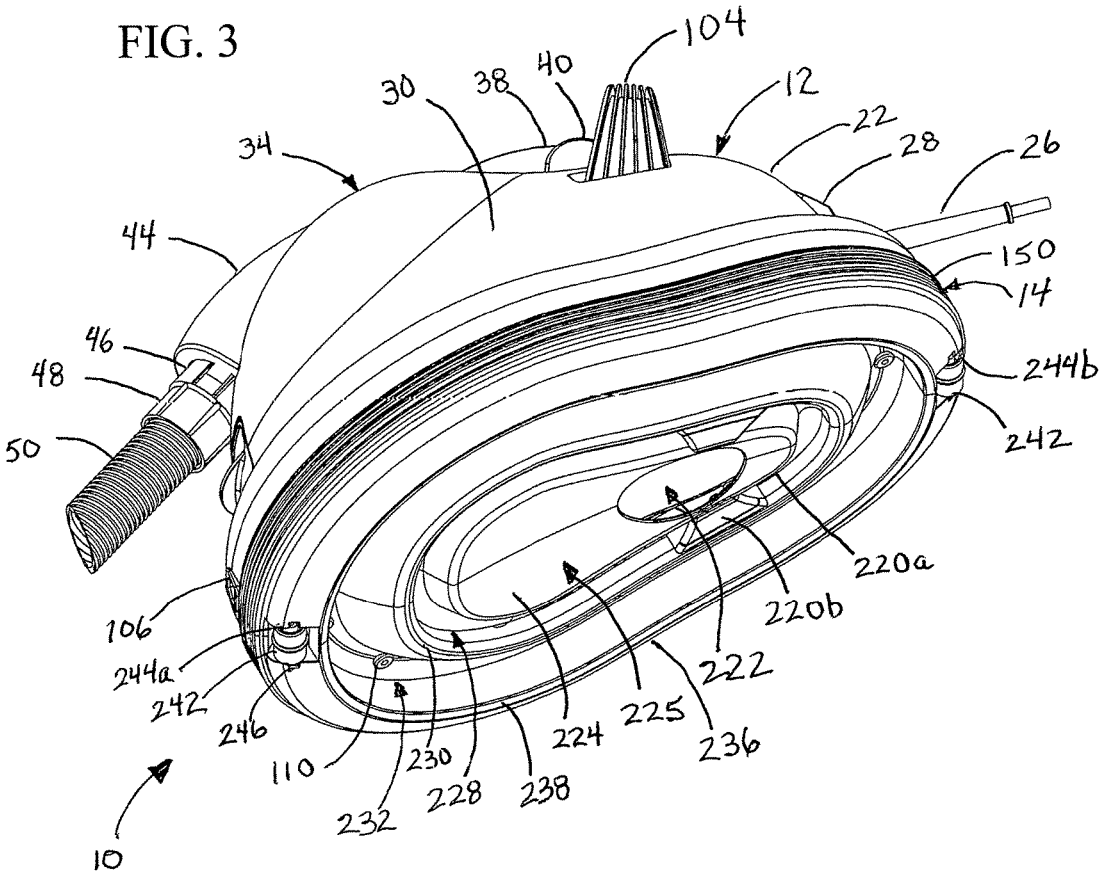
FIG. 3 is a bottom perspective view of the air cushion-supported vacuum cleaner canister assembly of FIG. 2, showing the air exhaust port and channels that produce the air cushion that supports the canister assembly above a floor surface.
Figure 4:
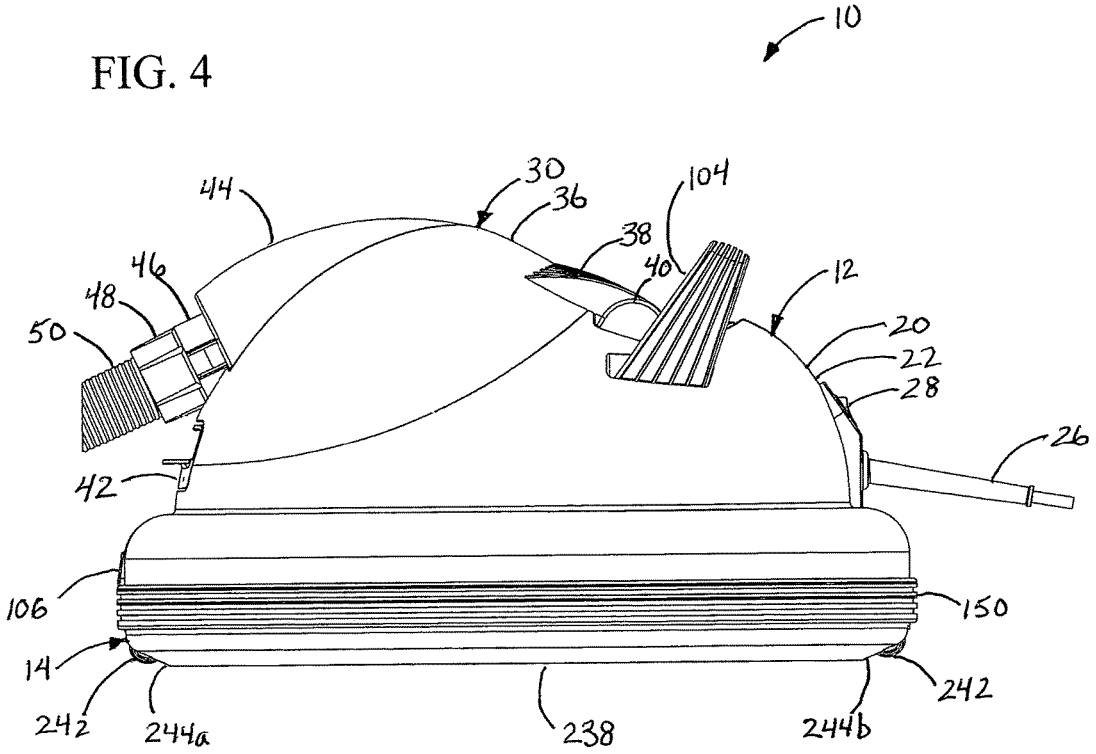
FIG. 4 is a side elevational view of the air cushion-supported vacuum cleaner canister assembly of FIGS. 2-3.
Figure 5:
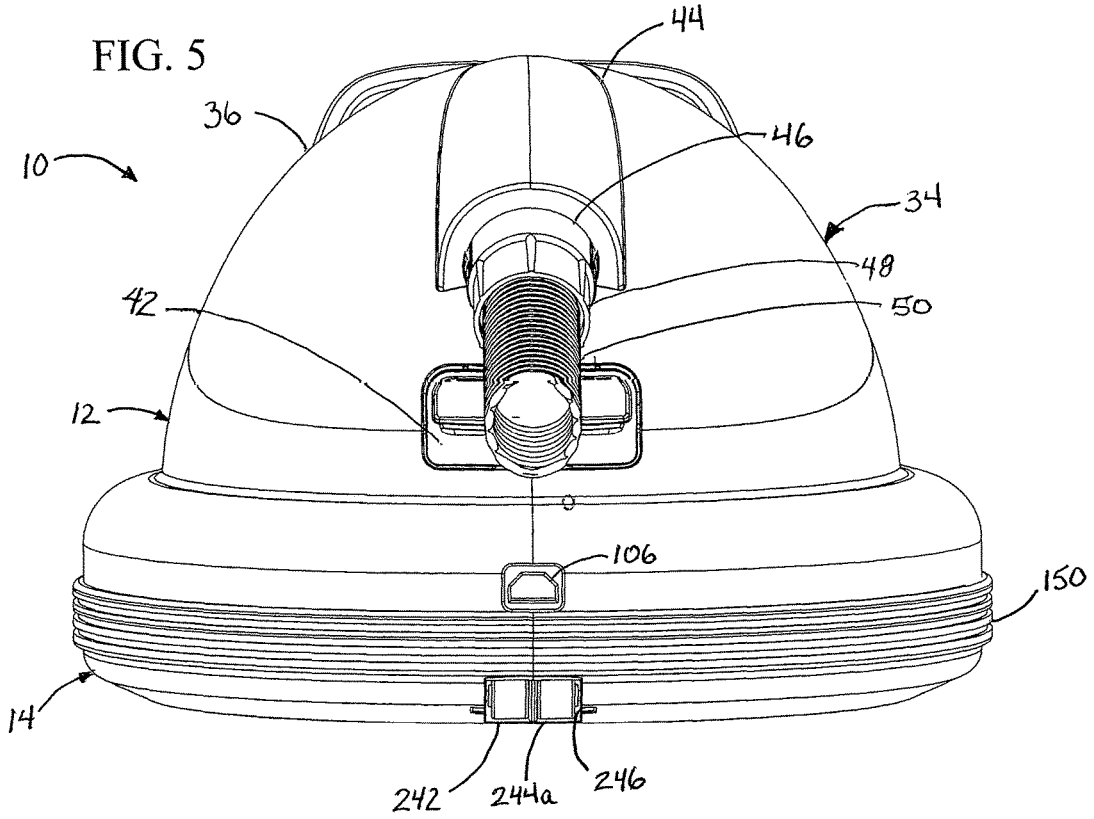
FIG. 5 is a front elevational view of the air cushion-supported vacuum cleaner canister assembly of FIGS. 2-4.
Figure 6:
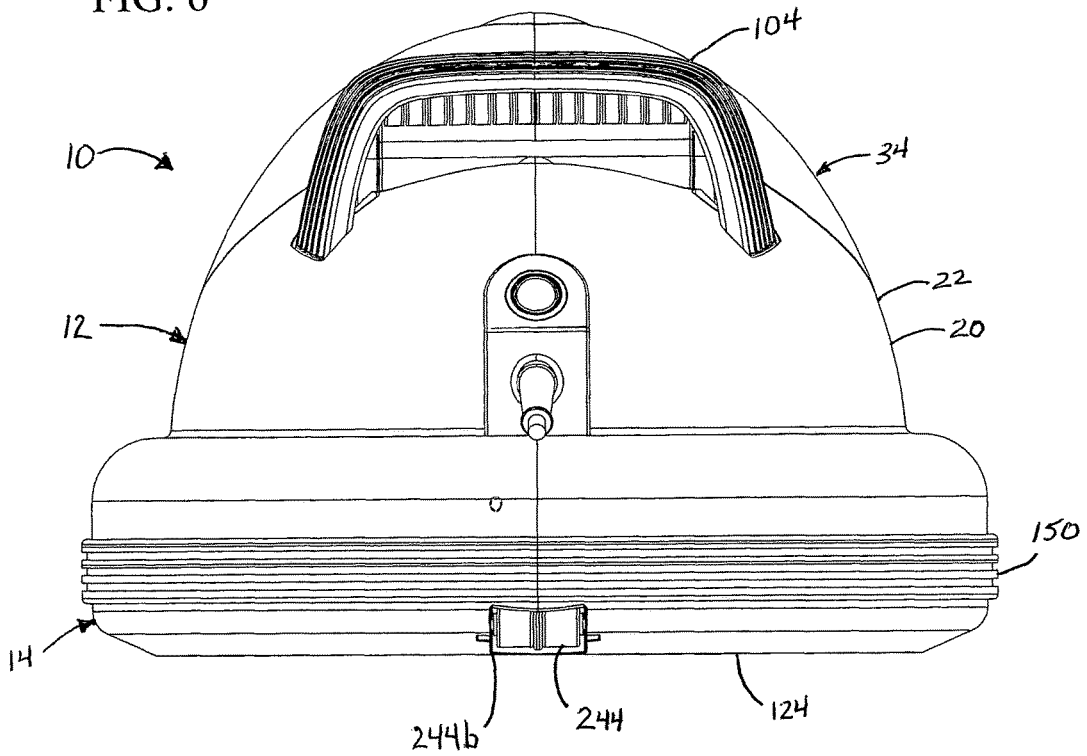
FIG. 6 is a rear elevational view of the air cushion-supported vacuum cleaner canister assembly of FIGS. 2-5.

FIG. 1 provides a cross-sectional view of an air cushion vacuum cleaner canister assembly 10 in accordance with a preferred embodiment of the present invention. As can be seen in FIG. 2, and as will be described in greater below, the canister assembly includes an upper body assembly 12 that houses the motor and filter chamber as well as the controls, and a base assembly 14 made up of components that cooperate to form the air cushion that supports the canister assembly above the floor surface.

As can be seen with further reference to FIG. 2 and also FIGS. 3-7, the upper housing assembly 12 includes a shell 20 having a rearward enclosure portion 22 that houses a blower motor 24 (see FIG. 1), with power being supplied to the latter via an electrical cord 26 controlled by an on-off switch 28. A second, somewhat larger enclosure portion 30 towards the forward end of the assembly houses a filter chamber 32 (see FIG. 1 and also FIGS. 8-9) that is accessible at the top via a pivoting lid assembly 34.

Figure 13:
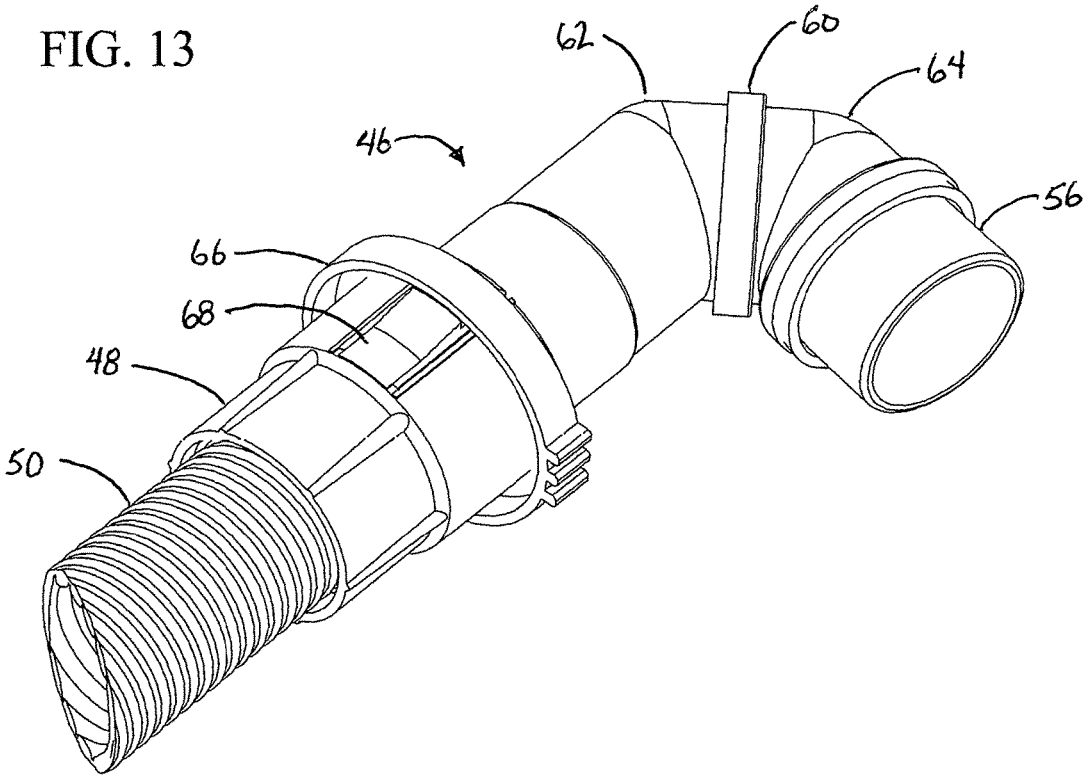
FIG. 13 is a perspective view of the hose connector and angled part of which there enters the filter chamber of the canister assembly via the lid assembly of FIG. 12.
Figure 14:
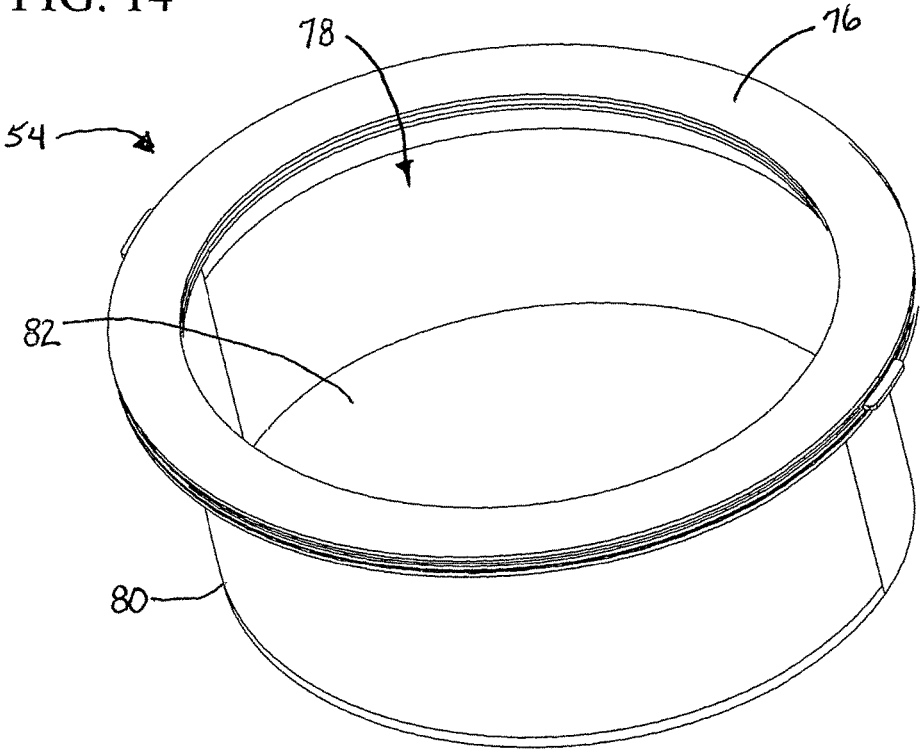
FIG. 14 is an upper perspective view of a dust collection bag that is received in the filter chamber of the upper housing assembly of FIGS. 8-9, and that rests at an angle therein as shown in FIG. 1.
Figure 15:
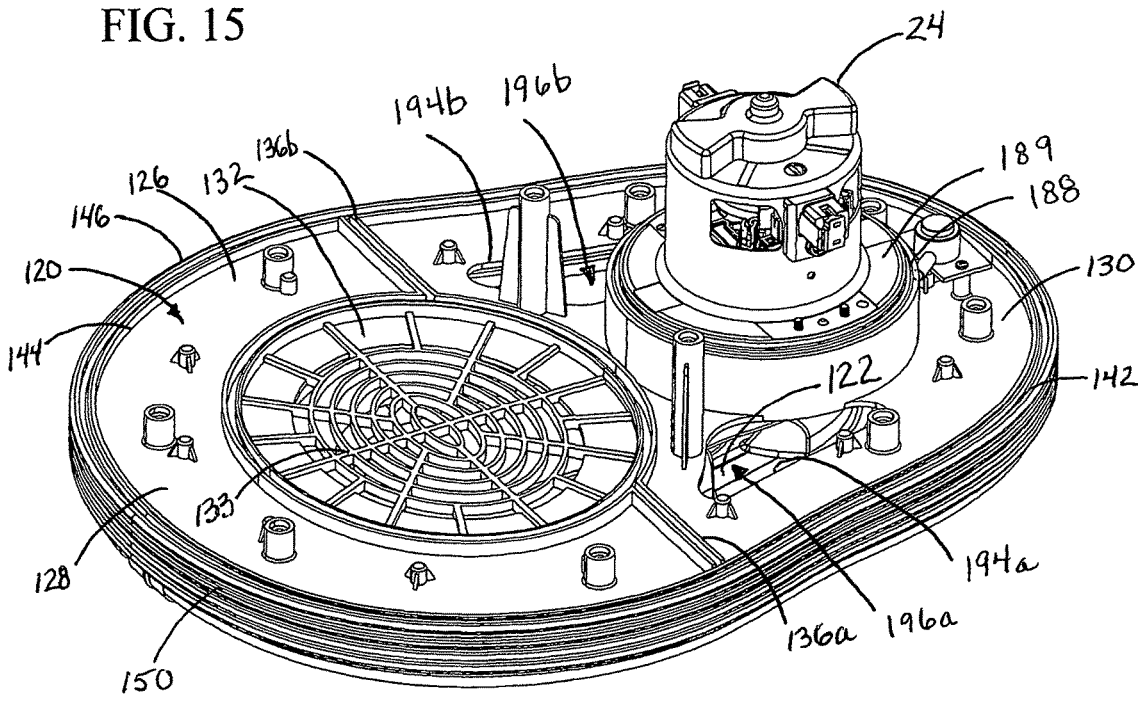
FIG. 15 is an upper perspective view of the base assembly of the air cushion-supported vacuum cleaner canister assembly of FIGS. 2-7, showing the relationship of the blower motor of the upper housing assembly thereto.
Figure 16:
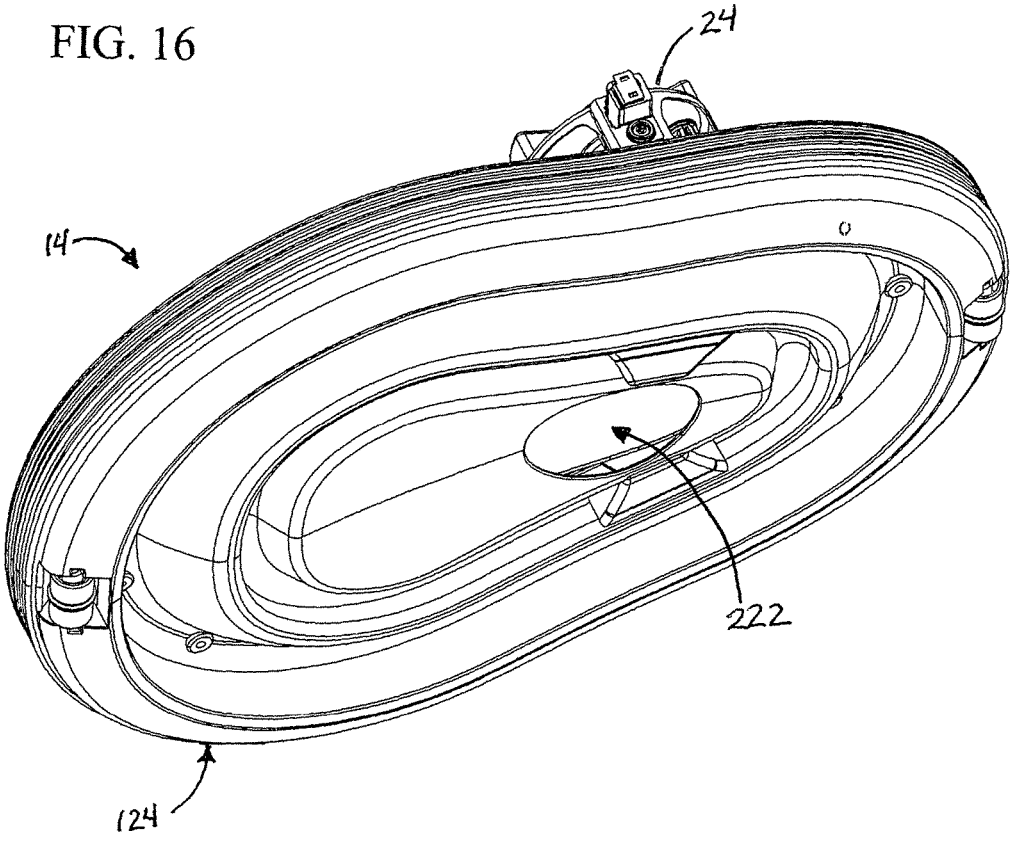
FIG. 16 is a lower perspective view of the base assembly of FIG. 15.
Figure 17:
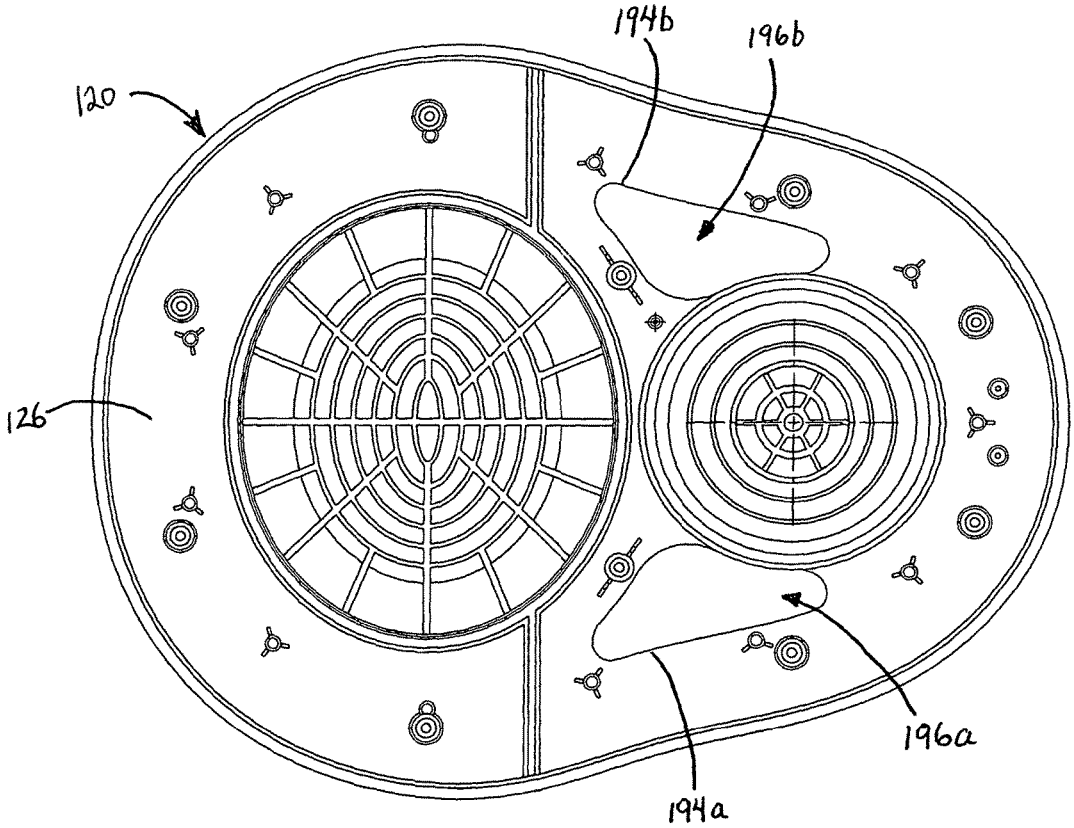
FIG. 17 is a top plan view of the divider plate and ducting cap of the base assembly of FIGS. 15-16.
Figure 18:
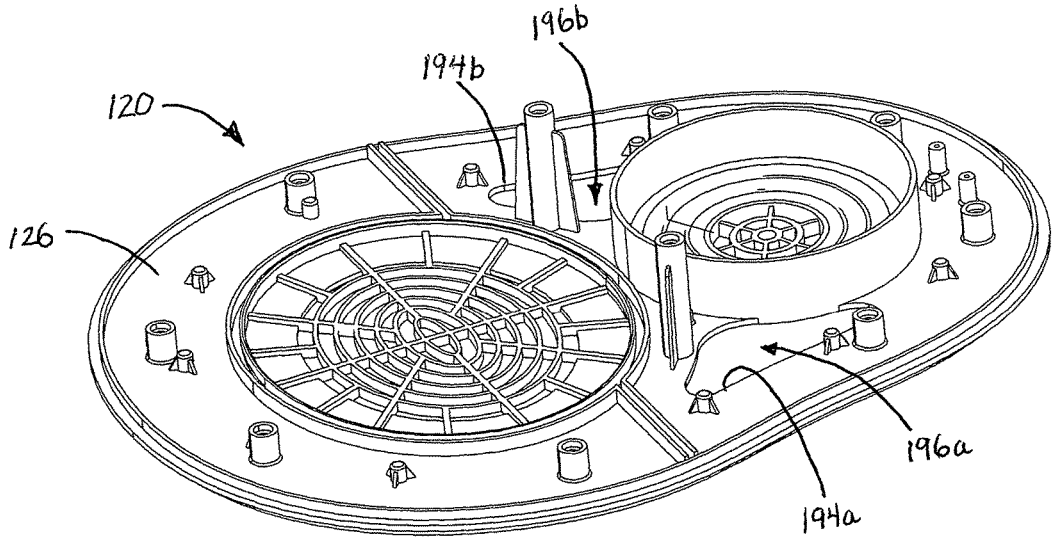
FIG. 18 is an upper perspective view of the divider plate of FIG. 17.

The lid assembly includes a somewhat raised cover 36 with a rearward extension 38 that is pivotally connected to hinge brackets 40 on the upper side of a rearward enclosure portion of shell 20 so as to form a hinge that allows the lid assembly to be raised and lowered from over the top of the filter chamber, the lid assembly being retained in the closed position during operation by a hand-operated latch 42 at the forward end of the lid assembly opposite the hinge. A blister 44 on the upward, forward part of the lid assembly encloses an inlet tube 46 having a downwardly angled intake end with an internally threaded connector piece 48 that mounts to the end of a flexible vacuum hose 50 leading to the power nozzle. Airflow and particulate borne thereon from the power nozzle, consequently enter the inlet tube 46 in the direction indicated by arrow 52, and then discharged into the filter chamber from the outward end 56 of the tube, the latter being angled downwardly from the intake end so that the airflow and particulate are directed into the chamber in a downward and rearward angle as indicated by arrow 58. As can be seen in greater detail in FIG. 13, the intake tube 46 includes an elbow 60 between the intake and discharge sections, formed by roughly 45° segments 62, 64 so that the airflow passes through two gradual turns rather than an abrupt right-angle change in direction. The tube 46 also includes a collar 66 and toothed prongs 68, by which the tube is mounted in the front of the lid assembly as shown in FIG. 1.

The forward downward angle at which the intake end of the inlet tube 46 and hose connector 48 extend from the front of the canister assembly 10 provides the substantial benefit of leading the hose 50 downwardly towards the floor surface so as to shorten the length of hose that must be supported by the air cushion at the front of the canister assembly, as compared, for example, with a horizontally directed hose connection in which several inches of hose must be supported before the hose is able to bend downwardly to the floor. The reduction in supported weight and also of the lever arm formed by the length of suspended hose serves to decease the downward forces on the front of the canister, as the hose and power nozzle are moved one way and then another by the user, thus aiding stability and also reducing the amount of power required in order to support the assembly on the cushion of air. Preferably, the angle is selected to provide the shortest length of hose from the intake to the floor without forcing the hose to bend or kink in a manner that would create resistance. In the illustrated embodiment a downward and forward angle about 20° below horizontal has been found particularly effective, with the intake end of the inlet tube being about 6 inches above the floor surface. Downward angles in the range of about 15°-30° may generally be suitable in combination with inlet heights in the range of about 4-8 inches, however it will be understood that the angles and heights may vary depending on hose weight, flexibility, and other design factors. As noted above, the elbow 60 of the inlet tube turns the air through roughly a right angle between the intake end and the discharge end 56 in the illustrated embodiment. However, it will be understood, however, that the intake and discharge angles are somewhat independent of one another, the former serving to direct the vacuum hose towards the airflow/particulate into the collection chamber in the manner described below.

Figure 8:
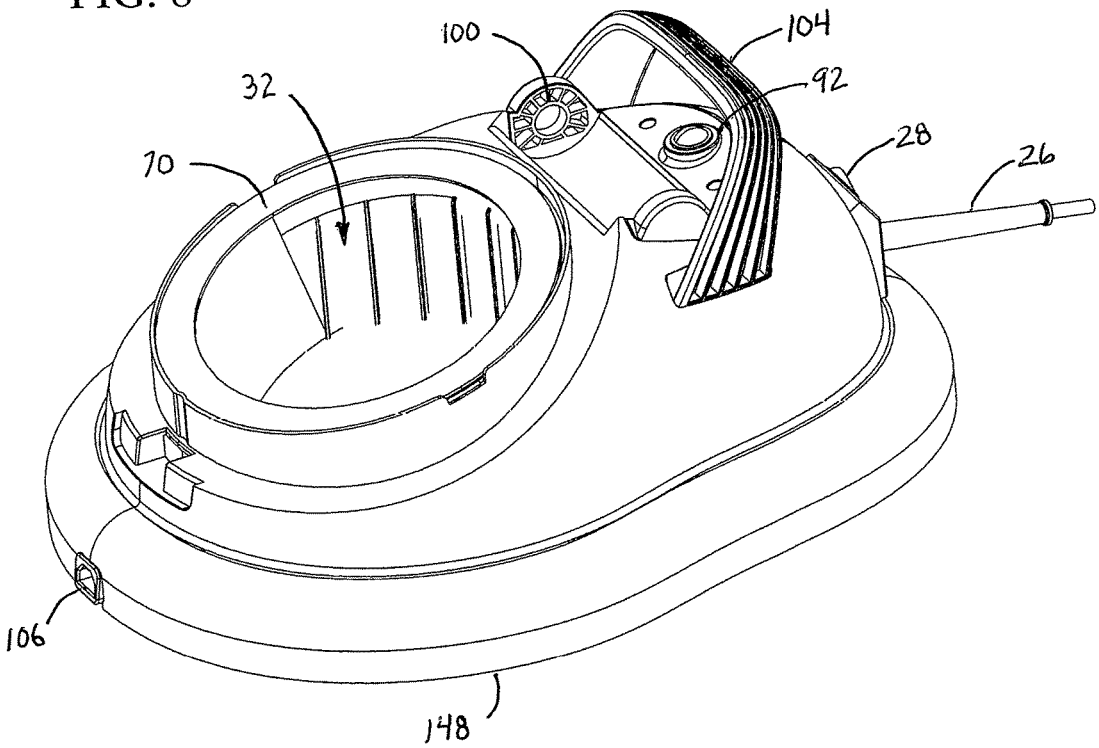
FIG. 8 is a top front perspective view of the upper housing assembly of the air cushion-supported vacuum cleaner canister assembly of FIGS. 2-7, with the cover of the filter compartment removed to show the structure of the latter.
Figure 9:
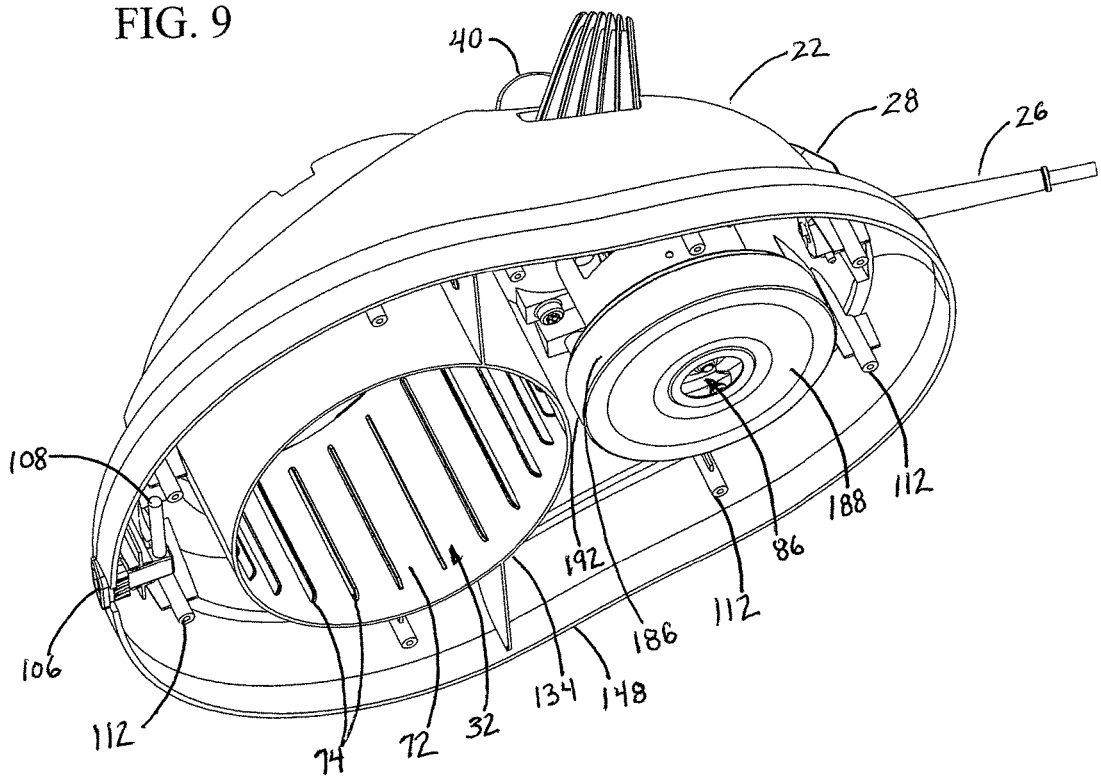
FIG. 9 is a lower perspective view of the upper housing assembly of FIG. 8, showing the lower end of the filter chamber and also the blower motor and other components within the housing.

As can be seen with further reference to FIG. 1 and also to FIGS. 8-9, the opening at the upper end of the filter chamber 32 includes an annular, circumferential flange 70 that extends in a plane sloped downwardly towards the front of the canister assembly so as to lie generally perpendicular to the discharge end 56 of the inlet tube. The chamber 32 itself, however, is formed by a generally vertical wall 72, generally oval in plan view, having raised ribs 74 forming air channels leading to the horizontal bottom of the chamber. Therefore, as can be seen in FIG. 1, the flow entering the filter chamber from the discharge end of the inlet tube, as indicated by arrow 58, is angled off and to the rear of the vertical axis of the filter chamber so that particulate material carried in the airflow is directed towards the rearward side of the chamber.

The filter chamber is generally oval in plan view, with its long axis transverse to the longitudinal axis of the assembly on which the chamber and motor are arranged, so that the rearward wall is relatively elongate as compared with the outboard sides of the chamber. The rearward wall is also significantly taller than the forward wall due to the downward slope of the upper edge of the chamber towards the forward end of the assembly. Moreover, the rearward wall of the filter chamber is located closest to the intake of the blower motor, with flow being communicated via an underlying duct-shaped passage as will be described below, with the vacuum being applied up the height of the rearward wall through the channels between ribs 74. These factors combine to generate the greatest amount of draw at the rearward portion of the wall of the filter chamber as compared with the other sides of the chamber.

A filter bag 54 placed in the chamber includes a somewhat rigid annular flange 76 that surrounds the upper opening 51 of the chamber, with a cylindrical wall 80 formed of flexible cloth paper or other suitable media and having a closed bottom 82. Accordingly, when the filter bag is placed in chamber 32, the flange 76 of the filter bag rests on the angled flange 70 at the top of the chamber, and is then clamped against the latter by the lower edge 84 of the shell 36 of the lid to form a perimeter seal. The flexible medium of the filter bag, however, allows the wall 80 of the bag to yield so as to conform generally to the vertical wall of the chamber, with the side and bottom of the bag being pushed to more vertical and horizontal alignments relative to their undeflected orientations as shown in phantom at 80' and 82' in FIG. 1. The canister assembly consequently is able to employ conventional cylindrical filter bags of an industry standard type, thereby achieving significant costs savings, however, it will be understood that in some instances filter bags specifically contoured to the shape of the filter chamber may be used. It will also be understood that some embodiments may feature a bagless design in which the particulate is captured within the chamber directly without the use of a bag.

In effect, the downward and rearward angle of the discharge outlet of the inlet tube directs the flow of air and particulate towards the rearward "corner" of the chamber towards which it is in turn drawn by the relatively greater vacuum at the rearward wall of the chamber. Preferably, the angle is such that the particulate is directed to an impact point somewhat forward of the bottom of the rearward side of the chamber wall 72, so that the momentum of the particulate material is dissipated by impacting the bottom of the filter bag and bouncing up against the filter medium on the side of the chamber. The heavier particulate consequently builds up against the rearward side of the chamber wall, while lighter dust and material tends to continue within the airflow so as to be captured elsewhere in the chamber. Since the rearward wall of the chamber is located generally adjacent motor 24, the weight of the material is thus concentrated proximate the center of mass of the canister assembly and consequently has a reduced impact on the attitude/inclination of the assembly, which in turn aids in maintaining stability as the assembly collects and fills with dust/dirt over a period of use as compared with the material being distributed randomly through the chamber.

By way of illustration, a filter bag of the type used in the illustrated embodiment contains an average of 580 g—greater than one pound—of particulate when full. Out of this, about 90% by volume is typically light "fluff" having minimal weight while only about 10% is formed of heavy particulate. Thus by accumulating the heavy particulate at the rearward wall of the chamber approximately one pound of the collected material is positioned closely adjacent the original center of gravity rather than being distributed randomly elsewhere. Since by comparison the blower motor—which is the heaviest component of the canister assembly—weighs approximately two pounds, it can be seen that the impact on stability is significant.

Figure 10:
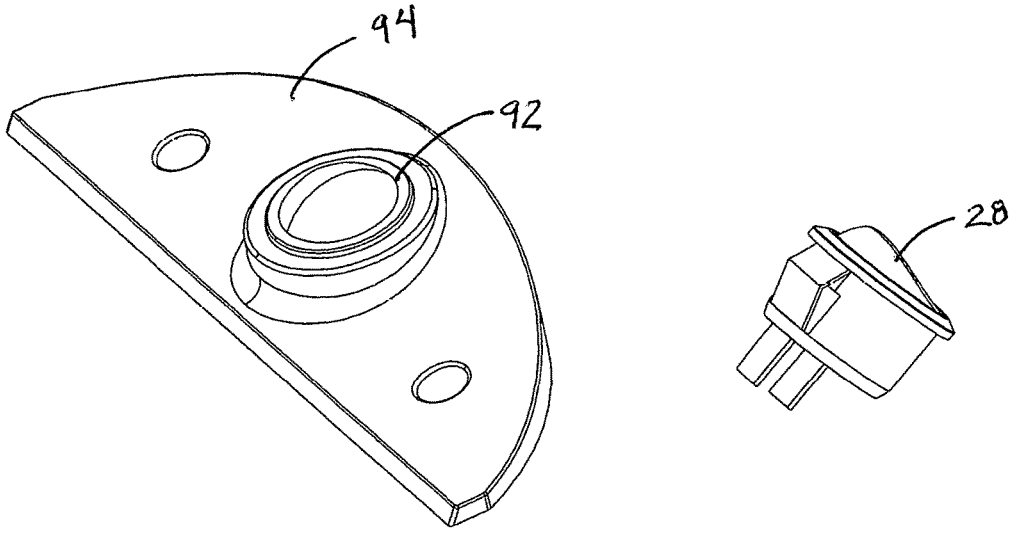
FIG. 10 is a perspective, exploded view of a full bag indicator assembly that is mounted in the upper housing of FIGS. 8-9.

After passing through the medium of the filter bag the airflow exits the open lower end of chamber 32 and is communicated via a passage 84 in an underlying cup member, as will be described below, to the intake opening 86 of blower motor 24. The airflow is discharged from the upper stack of the blower motor via radial ports 88 into a chamber 90 defined within the rearward enclosure 22 of the shell of the upper housing, from which it is directed downwardly to generate the air cushion in the manner described below. Preferably, the filter bag 54 is of a HEPA-type or other high efficiency type so that negligible particulate is discharged into the surrounding air. When the filter bag reaches or approaches its collection limit, a full bag indicator 92 illuminates in response to the reduced airflow so as to provide a visual indication that the bag needs to be emptied/changed, the indicator being mounted in a retainer plate 94 (see also FIG. 10) on the upper side of the housing.

Figure 12:
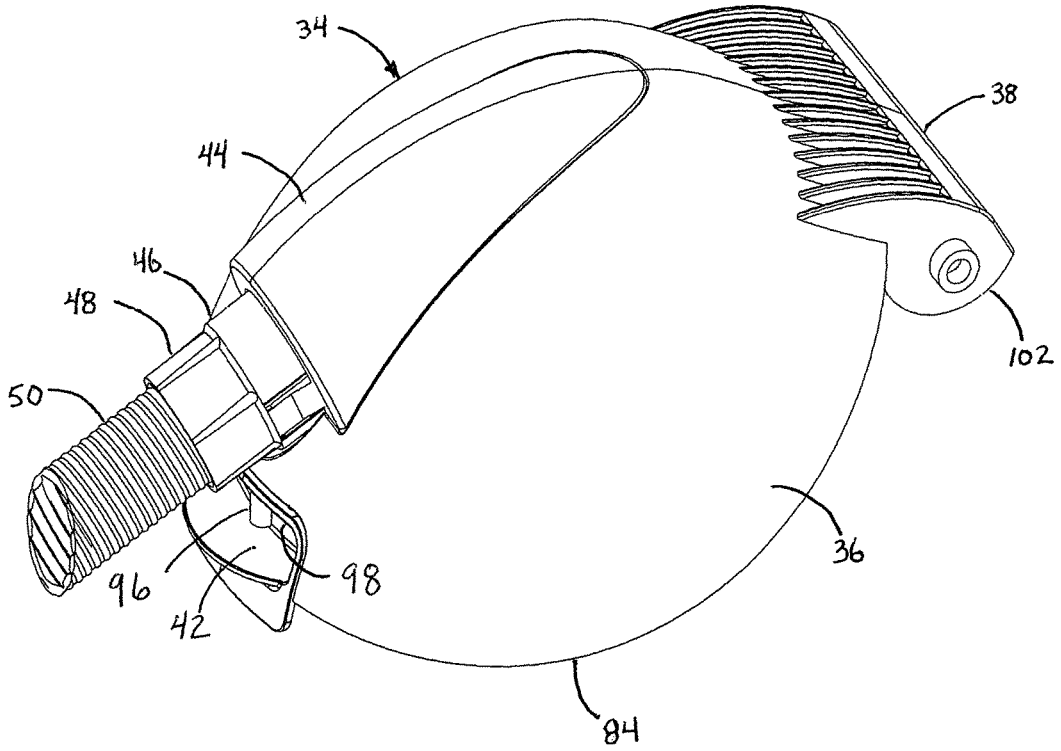
FIG. 12 is an upper perspective view of the filter chamber lid assembly of the canister assembly of FIGS. 2-7.

As noted above, the filter chamber and bag are accessed by opening the lid assembly 34 that is mounted atop the forward enclosure of the upper housing. The lid assembly is retained in the closed position by a releasable latch 42, having a catch portion that engages a cooperating lip on the main housing and a tension spring 96 that draws the lid downwardly to form the perimeter seal about the upper end of the filter chamber. To access the chamber, the user reaches into an opening 98 in the front of the latch and presses so as to pivot the catch portion out of engagement with the locking lip, freeing the lid to pivot upwardly about the hinge connection joining the rear of the lid to the hinge flanges 40 atop the rearward part of the housing; as can be seen in FIGS. 8 and 12, the hinge flanges 40 and the extension 38 include sockets and axle pins 100, 102 that form the hinge connection between the two parts. A loop handle 104 is also mounted to the rearward part of the upper case to permit convenient lifting and transportation of the canister assembly up stairs or to other locations.

An outlet jack 106 at the front of the housing supplies electrical power to an associated power nozzle, via a cord (not shown) that is associated with a power vacuum hose and that plugs into the outlet using a suitable connector. Power is in turn supplied to outlet 106 by a lead 108 (see FIG. 9) that is routed through the upper housing from the main cord 26 and switch 28.

Figure 7:
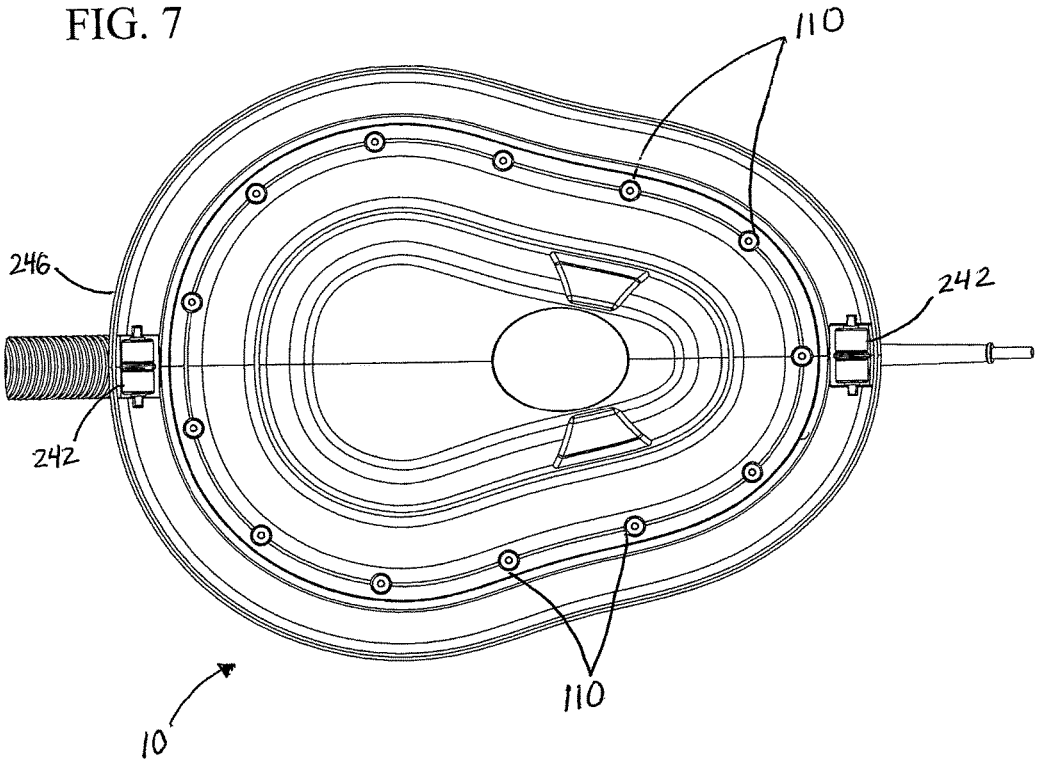
FIG. 7 is a bottom plan view of the air cushion-supported vacuum cleaner canister assembly of FIGS. 2-6, showing the configuration of the exhaust port and channels in the base panel of the assembly in greater detail.

Referring again to FIG. 1 and also to FIGS. 2, 7 and 9, the housing assembly 12 is mounted to base assembly 14, suitably by screws 110 that pass through cooperating openings 111 in the base assembly and that are threaded into cooperating bores 112 on the lower ends of mounting posts within the housing assembly.

As is shown in FIGS. 17-25, base assembly 14 is in turn constructed of a series of horizontal members, including, from top to bottom, a divider plate 120 that forms a generally airtight wall across the bottom of the upper shell except for controlled flow paths to and from the blower motor, a cap member 122 that cooperates with the divider panel to define a duct-shaped flow path from the bottom of the filter chamber to the intake of the blower motor and isolates the incoming suction air from the outgoing exhaust air, and a base plate 124 that receives the flow of air exhausted from the blower motor through openings in the divider panel and then discharges the flow through a port into a central pocket and surrounding channels to generate the air cushion that supports the canister assembly during operation.

As noted, the divider plate 120 forms the uppermost layer of the base assembly and mates with the lower side of the upper housing assembly. As can be seen in FIGS. 15 and 17-21, the divider plate includes a generally flat, horizontal main panel 126 that forms the wall dividing the base assembly from the upper housing. The panel has an outer edge that corresponds generally to the lower edge of the upper housing, with the forward end portion 128 of the panel being somewhat enlarged and the rearward end portion 130 being somewhat smaller so as to correspond to the larger and smaller enclosures formed in the shell of the housing.

Figure 11:
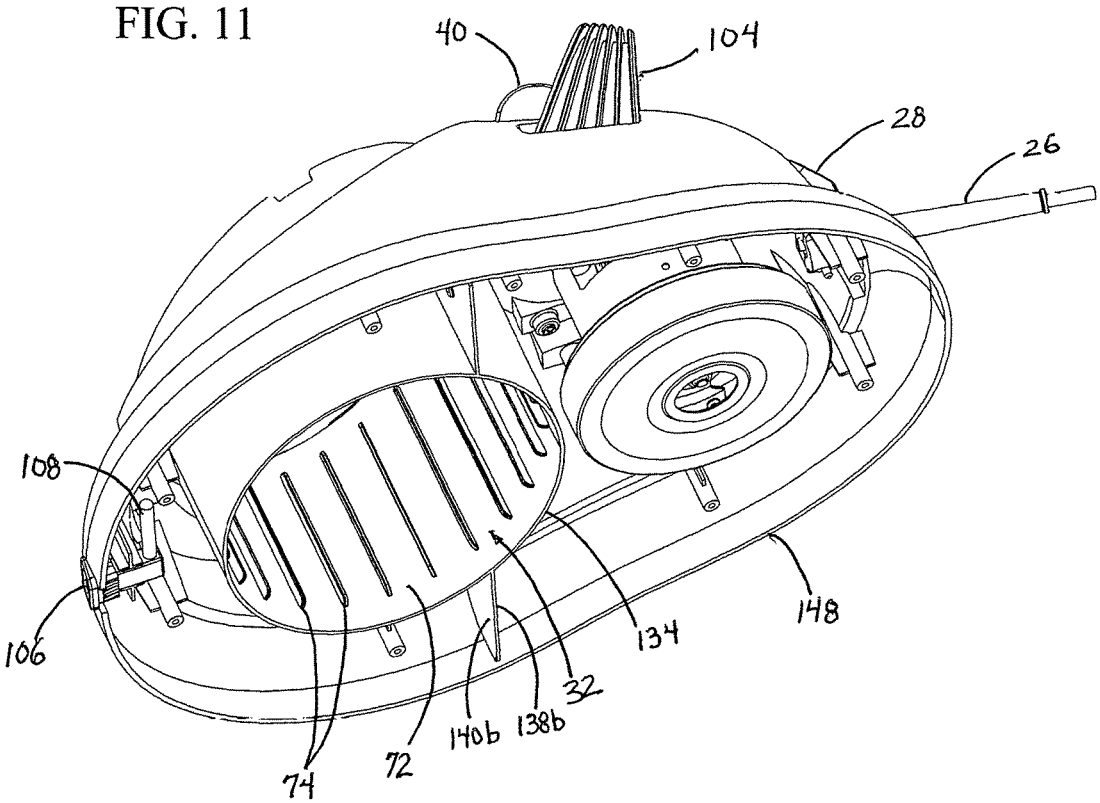
FIG. 11 is a lower perspective view of the upper housing assembly of FIGS. 8-9, showing more clearly the internal mounting structure of the housing.

An oval opening 132 is located in the forward portion 128 of panel 126 so as to be positioned below and communicate with the correspondingly shaped open lower end of the filter chamber 32 in the upper housing, a grate 133 being formed across the opening to support the bottom of the filter bag in the chamber. An upwardly facing annular channel 136 formed on the panel around opening 132 receives a cooperating lower edge 134 (see FIGS. 9 and 11) of the chamber wall so as to form a substantially airtight joint therewith. Similarly, upwardly facing lateral channels 136*a*, 136*b* receive the lower edges 138*a*, 138*b* of divider walls 140*a*, 140*b* extending upwardly into the housing so as to form a generally airtight divide between the forward and rearward enclosures 30, 22. A perimeter channel 142 formed between an upwardly projecting lip 144 around the edge of panel 126 and a corresponding lip 146 on surrounding bumper strip 150, in turn receives the lower edge 148 of the shell of the upper housing so as to complete the seal between the parts.

Figure 19:
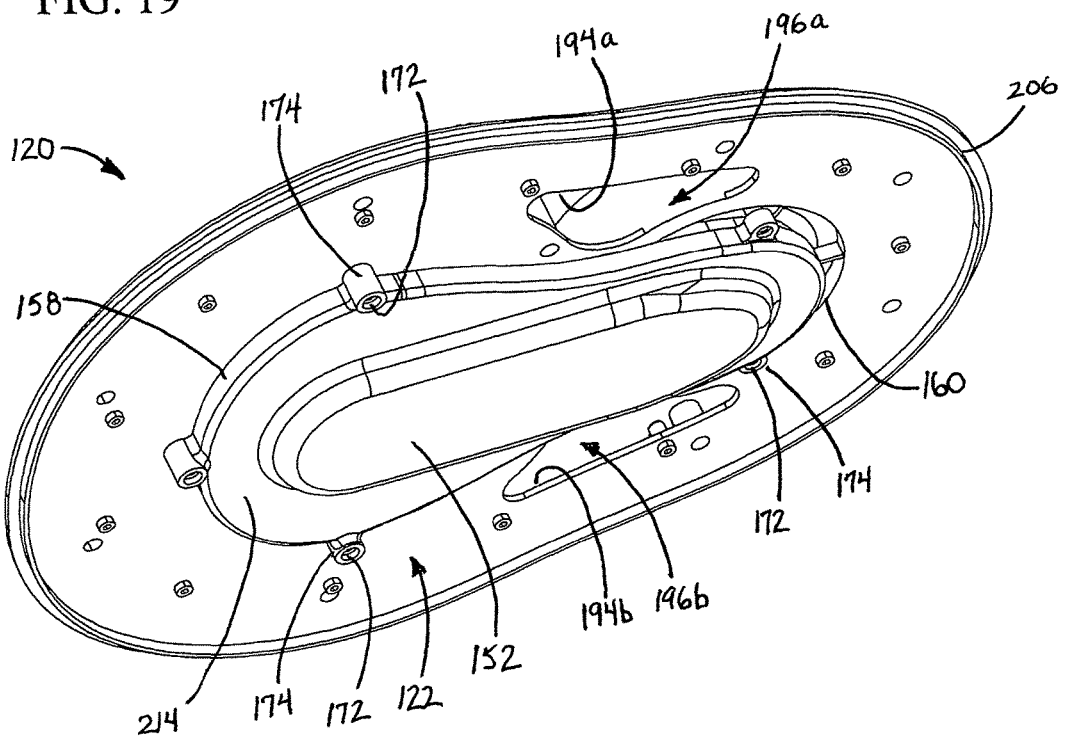
FIG. 19 is a lower perspective view of the divider plate and ducting cap of FIGS. 17-18.
Figure 22:
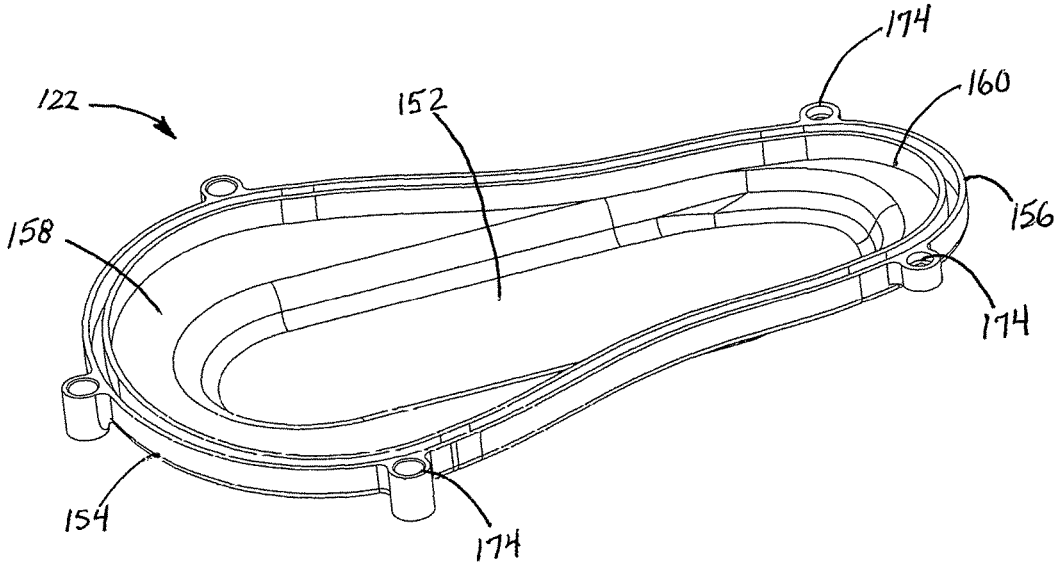
FIG. 22 is an upper perspective view of the ducting cap of FIGS. 17-19.
Figure 23:
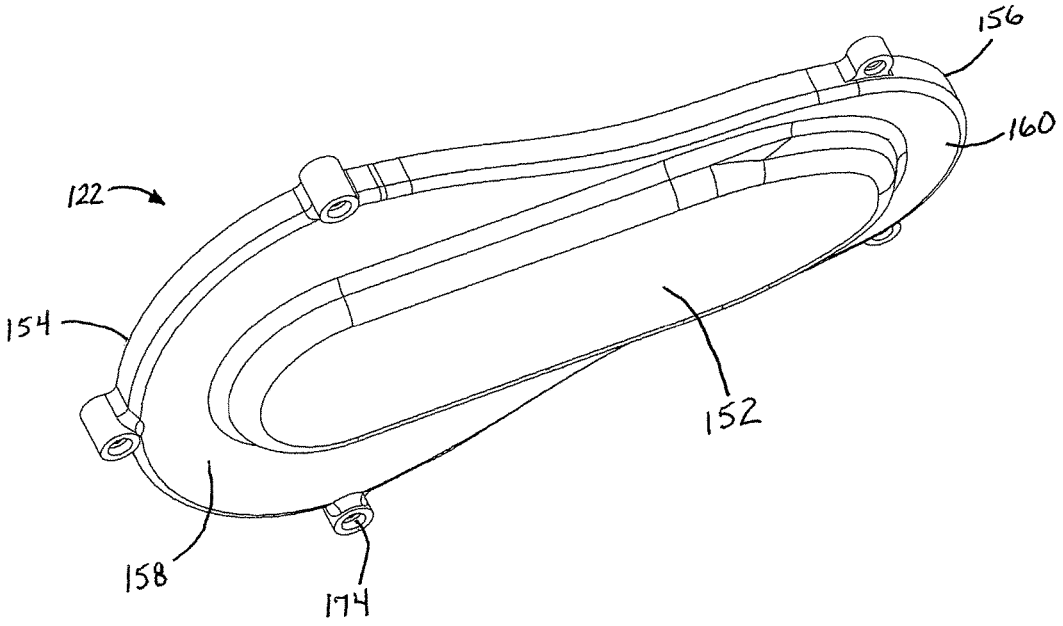
FIG. 23 is a lower perspective view of the ducting cap of FIG. 22.

As can be seen with further reference to FIG. 19, the cap member 122 is in turn mounted to the lower side of divider plate 120. As can be seen in FIGS. 22-23, the cap member is somewhat downwardly dished, with an elongate channel portion 152 extending generally longitudinally between the forward and rearward portions 154, 156 of the member. The forward end 154 includes an enlarged, somewhat oval intake portion 158 that is dimensioned and located to receive the flow of air exiting the bottom of the filter chamber 32 via the opening 132 in the divider plate, while the rearward end 156 includes a smaller, somewhat circular exhaust portion 160 that is positioned in register with a second, rearward opening 162 in the divider plate that leads back up to the intake 86 of the blower motor. An upwardly facing channel 164 is formed about the perimeter of the cap member, between inner and outer walls 166, 168, that mates with a cooperating depending ridge 170 (see FIG. 21) on the bottom of the divider plate, the cap member being secured to the bottom of the divider plate by screws 172 (see FIG. 19) that pass through cooperating bosses 174 about the perimeter of the cap member and are threaded into cooperating bores 176 on the underside of the divider plate. The cap member thus forms a shallow, somewhat tray-shaped airtight duct, that defines a flow passage between the forward and rearward openings 132, 162 in the divider plate without adding excessive height to the base assembly.

Figure 20:
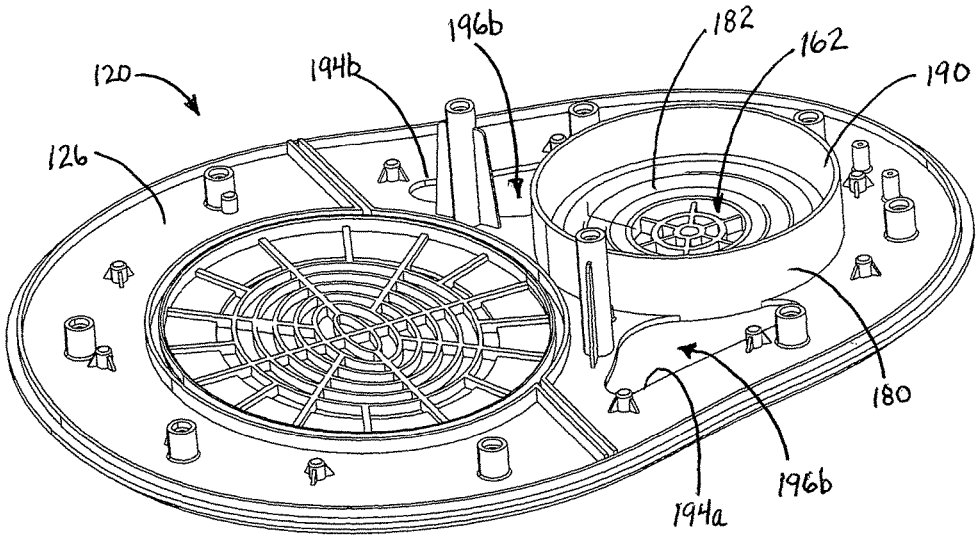
FIG. 20 is an upper perspective view of the divider plate of FIGS. 17-19.
Figure 21:
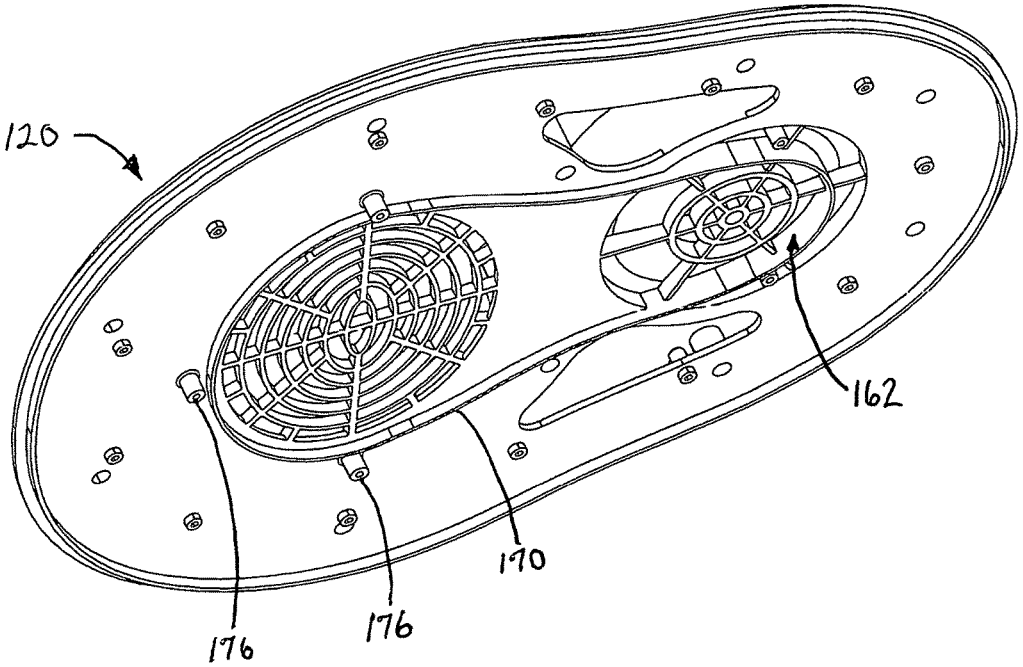
FIG. 21 is a lower perspective view of the divider plate of FIG. 20.

As can be seen in FIG. 20, on the upper side of the divider plate the rearward opening 162 is surrounding by an upwardly extending cylindrical sleeve 180, the opening 162 including a grate 182 to protect blower motor 24 against ingesting foreign matter. The upper end of the sleeve fits tightly over the outer wall 186 of an annular rubber seal 188 that is mounted on the lower end 189 of the blower motor around intake opening 86, the upper end 190 of the sleeve abutting an annular shoulder 192 on an upper part of the seal. The sleeve 180 on the divider plate consequently forms a substantially airtight upward passage communicating a flow of air from opening 162 to the intake 86 of the blower motor.

Operation of the blower motor 24 draws the airflow upwardly through intake opening 86 in the manner previously described and then discharges it at an increased pressure through ports 88 into chamber 90 within the rearward enclosure 22 of the upper housing assembly. The pressure within chamber 90 is constrained on the forward side by the transverse walls 140*a*, 140*b* that separate the front and rear enclosures, and on the bottom by the divider plate 120. As can be seen in FIGS. 17-20, the latter in turn includes cutouts 194*a*, 194*b* formed in opposite sides of panel 126, providing openings 196*a*, 196*b* that allow the air to escape downwardly from chamber 90. As is shown in FIG. 19, the two openings 196*a*, 196*b* are located outboard of the cap member that forms the forward-to-rearward duct between the filter chamber and blower intake. The air escaping through openings 196*a*, 196*b* thus passes by the sides of the cap member and enters the interior of the base plate 124 that forms the bottom of the base assembly.

Figure 24:
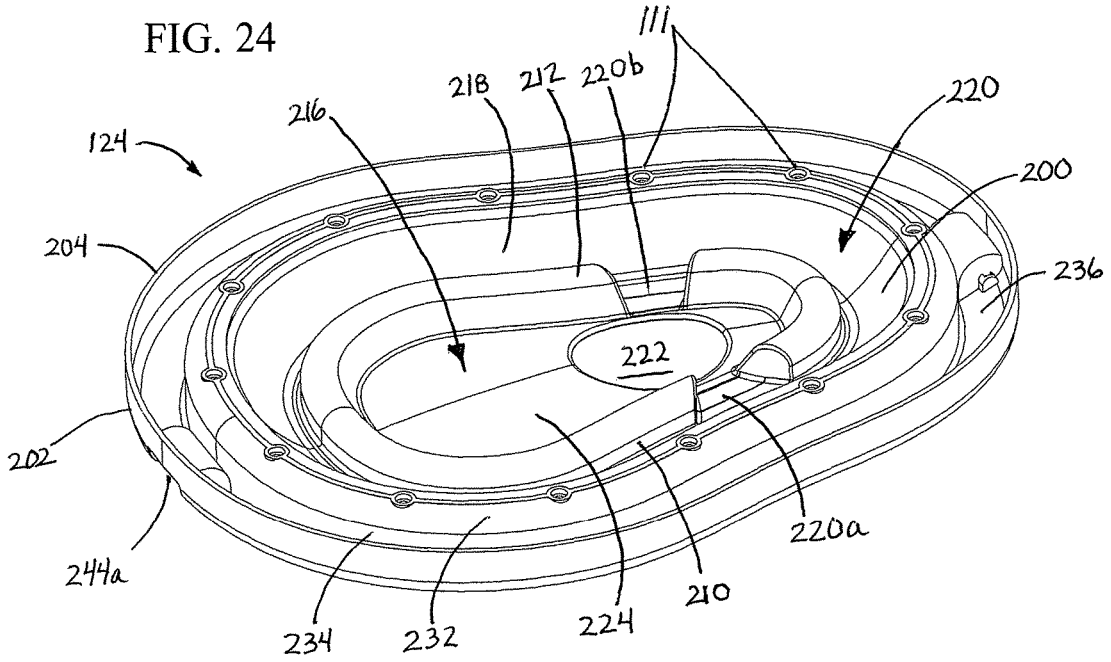
FIG. 24 is an upper perspective view of the hose plate of the base assembly of FIGS. 15-16.
Figure 25:
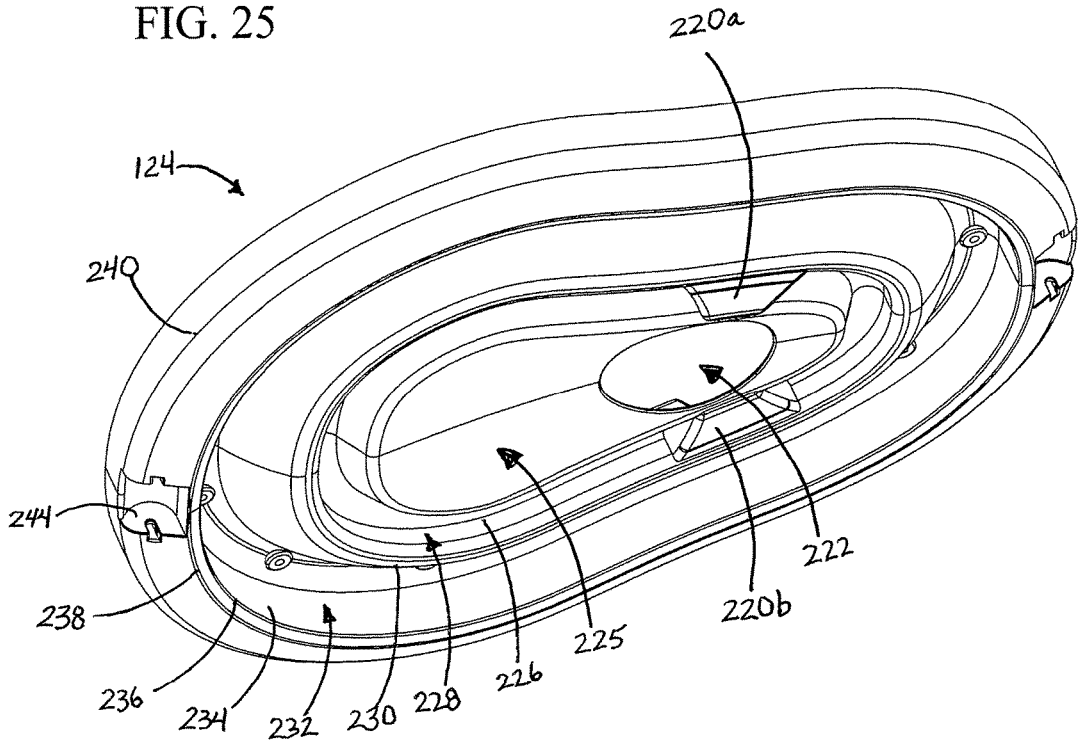
FIG. 25 is a lower perspective view of the base plate of FIG. 23.
Figure 26:
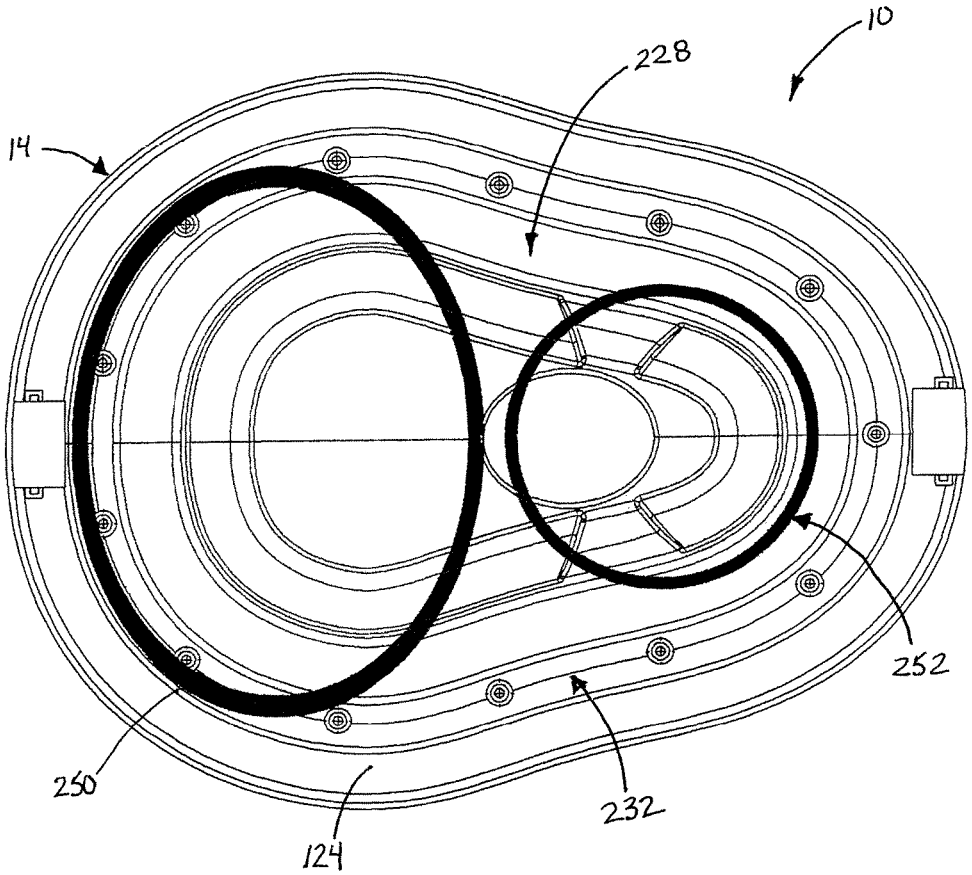
FIG. 26 is a bottom plan view of the canister assembly of FIGS. 1-7, overlain by a graphic representation of broadly oval/circular regions of the lift that are created by the features on the base plate beneath the areas of the filter chamber and the motor at the forward and rearward ends of the assembly.

As is shown in FIGS. 24 and 25, base plate 124 includes a generally horizontal downwardly dished main panel 200 having a series of generally concentric ridges and troughs that define features on the upper and lower sides of the plate. An upstanding wall 202 forms the perimeter of the plate, with the upper edge 204 of the wall mating with a channel formed between a depending perimeter lip 206 on the divider plate 120 and an adjoining lip on bumper 150 to form a substantially airtight enclosure over the lower sides of the divider plate 120 and cap member 122.

Referring again to FIGS. 24-25, the main panel 200 of the base plate includes an inner ridge 210 having a generally inverted U-shaped contour with a somewhat rounded upper edge 212. Ridge 210 follows a path corresponding generally to the perimeter of cap member 122, so that when installed as shown in FIG. 1 the upper edge 212 of the ridge contacts a generally horizontal lower perimeter surface 214 of the cap member to form a enclosure area 216 between the two pieces. The outwardly surrounding area 218 of the panel 200 is downwardly depressed relative to ridge 210, thus forming a channel-shaped plenum 220. The sides of the channel-shaped plenum are located beneath the passages 196*a*, 196*b* in the divider panel, so that air exiting chamber 90 through the opening enters the plenum below. Depressions in ridge 210, proximate the locations of openings 196*a*, 196*b* , in turn form passages 220*a*, 220*b* via which the flow of air enters the inner enclosure area, from which it then exits through an exhaust port 222 formed in the floor 224 of the enclosure area.

As can be seen in FIG. 25, the exhaust port 222 is formed in the base plate 124 so as to be located on the longitudinal centerline in an area generally beneath the center of mass of the canister assembly. The exhaust port is located within a domed pocket 225 formed by the upwardly convex floor 224 of the overlying chamber area 216, so that airflow exiting the port immediately enters and pressurizes the pocket, a larger and broader portion of the pocket being located forwardly of the exhaust port and a smaller and narrower portion of the pocket being located rearwardly of the pocket. The flow is directed downwardly by the curved surface of the pocket and out over the outer edge 226 thereof, generating substantial lift in an area that is concentrated generally beneath the center of mass of the canister assembly and that is surrounded by the perimeter structures of the bottom plate.

Air passing under the outer edge 226 of the pocket area spills outwardly and upwardly into an upwardly recessed channel 228, that is formed by the lower surface of ridge 210 on the upper side of the base plate. The airflow fills channel 228 and is distributed by the channel around the underside of the base plate, at a somewhat lower pressure than in the domed pocket 225. The channel thus creates a dense cushion of air, with the flow being directed downwardly by a generally vertical outer wall 229 of the channel and then outwardly under the outer lip 230 of the channel, producing a second, evenly distributed zone of lift extending concentrically around and outside of pocket 225.

From ridge 230 the airflow again spills upwardly, into a larger channel 232 that extends concentrically about the first channel 228. The airflow fills and is partially contained in the second channel 232 in a manner similar to the first, again with a drop in pressure, with the flow thus being balanced and distributed by channel 232 around the lower perimeter of the base assembly. The channel creates another dense cushion of air, with flow out of channel 232 being directed towards the floor surface by outer wall 234 and then passing under depending outer ridge 236 and escaping outwardly, generating another concentrically arranged zone of lift.

As can be seen in FIG. 1, the outer ridge 236 of channel 232 projects the lowest of the ridges on the bottom of the base plate, thus defining an escape plane 237 of the bottom of the canister assembly, and is provided with a chamfered edge 238 that minimizes the area of potential contact with carpet or other floor surfaces. The perimeter surface 234 of the base plate outside of the ridge in turn slopes upwardly so as to minimize friction/resistance in the event of contact. Horizontal axis rollers 242 are mounted in front and rear sockets 244*a*, 244*b* on axle pins 246 to protrude slightly from sloped surface 240 at locations above the escape plane 237, to aid in passing over transition, thresholds and other irregularities/obstacles involving contact between the sloped face 240 and the floor surface. A greater or lesser number of rollers may be employed in some instances, e.g., multiple rollers at the front or rear only a single roller at the front or rear.

As can be seen in FIG. 25, the shape of the domed pocket 225 and the paths of the channels surrounding it combine with the overall outline of the bottom of the base plate—larger and broader in the front portion and smaller and narrower in the rear portion—to produce correspondingly shaped regions of lift positioned generally forwardly and rearwardly of the center of gravity of the canister assembly. In particular, the configuration produces a broadly oval lift region 250 with a long axis transverse to the assembly forward of the center of gravity, and a broadly circular lift region 252 centered aft of the center of gravity. In addition to providing lift to support the canister assembly, the relationship of the lift regions provide additional stability against tilting and diving in side-to-side and front-to-rear directions.

The series of channels and ridges generating zones of lift arranged concentrically about the domed pocket containing the greatest pressure produces an exceptionally strong and stable cushion of air that not only allows the canister assembly to glide smoothly over the floor but also resists disruption by transitions, discontinuities, areas of uneven pile, and other irregularities. The concentrically arranged channels distribute the airflow and reestablish an even lift around the base of the canister assembly, helping compensate for changes in loading as the canister moves over the floor, and also providing a degree of redundancy avoiding disruption of even lift when passing over thresholds and other obstructions. The structure also allows the cushion of air to be generated in a highly efficient manner, containing and focusing the flow to fully utilize the available force prior to the flow escaping from under the assembly. Furthermore, the location and distribution of the lift are correlated to the center of mass and distribution of weight of the canister assembly to maximize efficiency. It will be understood that while in the illustrated embodiment the central dome is circumscribed by two channels/ridges, the number and arrangement may vary in some embodiments depending on the overall weight, dimensions, and distribution of weight of the canister assembly, and other design factors; furthermore, while each of the channels has a substantially uniform cross-section in the illustrated embodiment, channels that are graduate or otherwise tailored to address particular loads, dimensions or other design factors may be employed in some embodiments.

It will be understood that the scope of the appended claims should not be limited by particular embodiments set forth herein, but should be construed in a manner consistent with the specification as a whole.

What is claimed is:

1. A vacuum cleaner canister assembly that generates an air cushion to support said canister assembly over a floor surface, said canister assembly comprising:

a base assembly that generates an air cushion to support said canister assembly, said base assembly comprising:

an exhaust port through which a flow of air exhausted from a motor of said canister assembly is discharged below said base assembly;

an upwardly domed pocket having said exhaust port located therein so that said flow of air exiting said exhaust port is received and constrained within said domed pocket;

a first depending ridge circumscribing said domed pocket, under which air escapes from said pocket so as to generate lift against a floor surface underlying said base assembly;

an upwardly recessed first channel circumscribing said first ridge into which said air escaping under said first ridge flows so as to be distributed about said domed pocket;

a second depending ridge circumscribing said first channel under which said flow of air escapes from said first channel so as to generate lift against said underlying floor surface;

a second upwardly recessed channel circumscribing said second ridge that receives and distributes said flow of air about said second ridge; and a third depending ridge circumscribing said second channel under which said flow of air escapes from said second channel so as to generate additional lift against said underlying floor surface.

2. The vacuum cleaner canister assembly of claim 1, wherein said upwardly recessed channels are arranged generally concentrically about said domed pocket that receives said flow of air from said exhaust port.

3. The vacuum cleaner canister assembly of claim 2, wherein said domed pocket is located generally beneath a center of mass of said vacuum cleaner canister assembly.

4. The vacuum cleaner canister assembly of claim 3, wherein said domed pocket and said upwardly recessed channels cooperate to form forward and rearward regions of lift aligned generally along a longitudinal axis of said canister assembly.

5. The vacuum cleaner canister assembly of claim 4, wherein said forward region spans a relatively broader width under said canister assembly and said rearward region spans a relatively narrower width under said canister assembly.

6. The vacuum cleaner canister assembly of claim 5, wherein said forward and rearward regions are located respectively generally forwardly and rearwardly of a center of gravity of said canister assembly.

7. The vacuum cleaner canister assembly of claim 1, further comprising:

an upper housing assembly, comprising:

a filter chamber; and a blower motor that draws said flow of air through said filter chamber and expels said flow of air through said exhaust port into said domed pocket on said bottom of said base assembly.

8. The vacuum cleaner canister assembly of claim 7, wherein said filter chamber is located towards a first end of said canister assembly and said lower motor is located towards a second end of said canister assembly.

9. The vacuum cleaner canister assembly of claim 8, wherein said center of gravity of said canister assembly is located generally intermediate said filter chamber and said blower motor.

10. The vacuum cleaner canister assembly of claim 7, wherein said upper housing assembly further comprises:

an inlet tube in fluid communication with a vacuum hose, said inlet tube having a discharge end that is angled to direct said flow of air towards a rearward side of said filter chamber that is located towards said center of mass of said canister assembly, so that heavy particulate carried by said flow of air accumulates adjacent said rearward wall of said filter chamber so as to be generally proximate said center of mass of said canister assembly.

11. The vacuum cleaner canister assembly of claim 10, wherein said upper housing assembly further comprises:

a filter bag that is removably placed in said filter chamber to collect said particulate that is carried by said flow of air.

12. The vacuum cleaner canister assembly of claim 10, wherein said inlet tube further comprises:

an inlet end that is mountable to said vacuum hose in generally axial relationship thereto.

13. The vacuum cleaner canister assembly of claim 12, wherein said inlet end of said inlet tube is angled forwardly and downwardly so that said vacuum hose extends therefrom forwardly and downwardly towards said floor surface so as to reduce loading on said canister assembly due to weight of said vacuum hose.

14. A vacuum cleaner canister assembly that generates an air cushion to support said canister assembly over a floor surface, said canister assembly comprising:

a base assembly that generates an air cushion to support said canister assembly, said base assembly comprising:

an exhaust port through which a flow of air exhausted from a motor of said canister assembly is discharged below said base assembly;

an upwardly domed pocket having said exhaust port located therein so that said flow of air exiting said exhaust port is received and constrained within said domed pocket, said domed pocket being located generally beneath a center of mass of said vacuum cleaner canister assembly;

a first depending ridge circumscribing said domed pocket, under which air escapes from said pocket so as to generate lift against a floor surface underlying said base assembly;

an upwardly recessed first channel circumscribing said first ridge into which said air escaping under said first ridge flows so as to be distributed about said domed pocket;

a second depending ridge circumscribing said first channel under which said flow of air escapes from said first channel so as to generate lift against said underlying floor surface;

a second upwardly recessed channel circumscribing said second ridge that receives and distributes said flow of air about said second ridge;

a third depending ridge circumscribing said second channel under which said flow of air escapes from said second channel so as to generate additional lift against said underlying floor surface;

said upwardly recessed channels being arranged generally concentrically about said domed pocket that receives said flow of air from said exhaust port; and said domed pocket and said upwardly recessed channels cooperating to form forward and rearward regions of lift aligned generally along a longitudinal axis of said canister assembly and located respectively generally forwardly and rearwardly of said center of gravity of said canister assembly; and an upper housing assembly, comprising:

an blower motor that draws said flow of air through said filer chamber and expels said flow of air through said exhaust port into said domed pocket on said bottom of said base;

a filter chamber; and an inlet tube in fluid communication with a vacuum hose, said inlet tube having a discharge end that is angled to direct said flow of air towards a rearward side of said filter chamber that is located towards said center of mass of said canister assembly, so that heavy particulate carried by said flow of air accumulates adjacent said rearward wall of said filter chamber so as to be generally proximate said center of mass of said canister assembly.

* * * * *